United States Patent [19]

Barazone

[11] Patent Number: 4,742,970

[45] Date of Patent: May 10, 1988

[54] PAVING FABRIC STRETCHING MECHANISM

[76] Inventor: Mounque Barazone, P.O. Box 5217, Cottonwood, Calif. 96022

[21] Appl. No.: 34,907

[22] Filed: Apr. 6, 1987

Related U.S. Application Data

[63] Continuation of Ser. No. 822,201, Jan. 24, 1986, Pat. No. 4,664,332, which is a continuation-in-part of Ser. No. 529,627, Sep. 9, 1983, Pat. No. 4,555,073.

[51] Int. Cl.[4] ..... E01C 11/16

[52] U.S. Cl. ..... 242/86.52; 404/100

[58] Field of Search ..... 242/86.52, 86.5 R, 85, 242/76; 15/78; 404/100, 83

[56] References Cited

U.S. PATENT DOCUMENTS

| | | | |
|---|---|---|---|
| 2,592,437 | 4/1952 | Pedus | 242/86.52 X |
| 3,559,914 | 2/1971 | Alderman | 242/86.52 |
| 4,397,241 | 8/1983 | Newman | 242/86.52 X |

FOREIGN PATENT DOCUMENTS

| | | | |
|---|---|---|---|
| 2537990 | 3/1976 | Fed. Rep. of Germany | 242/86.52 |
| 1490803 | 6/1967 | France | 242/86.52 |

*Primary Examiner*—John M. Jillions
*Attorney, Agent, or Firm*—Bielen and Peterson

[57] ABSTRACT

A device for supporting a roll of material to a vehicle utilizing a first and second arm having a tensioning mechanism for tightening the roll of material. The device also includes a support bracket which adjustably holds the second arm in relation to the first arm. The support bracket and first arm are mounted to a selected position on the vehicle.

1 Claim, 5 Drawing Sheets

PAVING FABRIC STRETCHING MECHANISM

CROSS REFERENCES TO RELATED APPLICATIONS

This is a continuation of application Ser. No. 822,201, filed Jan. 24, 1986, now U.S. Pat. No. 4,664,332, which is a continuation-in-part of a copending application, Ser. No. 529,627 filed Sept. 9, 1983, now U.S. Pat. No. 4,555,073.

BACKGROUND OF THE INVENTION

The presentation invention relates to a novel and useful apparatus for laying paving fabric.

A recent development in the construction and repair of asphalt surfaces includes the laying of a sheet of paving fabric generally formed from polypropylene, polyethylene or the like. It has been found that the use of paving fabric permits the binding of the old asphalt to the new asphalt overlay while maintaining a moisture impermeable barrier. The result is that reflective cracking of asphalt surfaces is prevented in the future.

In the past, the paving fabric has been placed down manually but this has proved to be unsatisfactory since the sheet material being unrolled must be aligned with the paving surface perimeter and must be free of wrinkles. Reference is made to the U.S. Pat. No. 3,913,854 to McClure which describes a device for tensioning fabric rolls. The prior art fabric roll laying devices suffer from the inability to accomodate different sized rolls and the elimination of wrinkles from the fabric after it is placed on the surface being paved. In addition, the prior devices have been unwieldy and are not compactly transported from one worksite to another.

A paving machine which overcomes the obstacles and shortcomings of the devices of the prior art would be a great advance in the field of constructing and repairing paved surfaces.

In accordance with the present invention a novel apparatus for laying paving fabric is provided.

The device of the present application is normally vehicle mounted and dispenses paving fabric from a roll. The apparatus employs a first member which has a lateral or transverse dimension and a second member having a lateral or transverse dimension such that the members are spaced from one another. The roll is supported from the second member and permitted to unwind with vehicle movement. The fabric is then laid over the surface in this manner.

Means is also used for applying a downward force on the unwound paving fabric as it passes beneath the vehicle. Said force applying means being connected to the first member. Such means for applying a downward force on the unwound paving fabric may include a first element and a second element lying adjacent the first element and being angularly disposed in relation to the same.

The means for applying a downward pressure or force on the unwound paving fabric may include brushes in the form of first and second elongated brush units each connected to said first and second elements respectively. The brush units may form an angle with the apex of the angle lying closer to the fabric than the legs of the angle. Thus, a vee or a chevron is formed with points toward the direction of travel of the vehicle. The first and second elements may be supported by said second member, although a portion of the first and second elements remains spaced from the second member.

Means is also found to adjust the downward force provided by the means for applying the downward force.

The apparatus of the present invention may also embrace the use of means for adjusting the lateral dimension of the second member. Such adjustment may take the form of one or more sections being telescopically movable in relation to one another. Of course, the means for supporting the roll would be attached to an elongated section of the telescopically movable sections.

To maintain the tension on the roll, a bar may be connected to either the first or second member between the fabric roll and the surface. The bar may take the form of a cylindrical member fasten to arms extending from the first or second members. In addition, a platform may be provided on these arms to steady or hold the fabric roll as it is being loaded on the machine.

The apparatus of the present invention may also entail the provision for means for rotating a portion of the first and second members upwardly. Such rotation would place the apparatus in a compact configuration that adds to the mobility of the apparatus.

The present application may also be deemed to include a device for supporting a roll of material on a vehicle. The device has first and second arms each including means for tensioning the roll of material. A support bracket adjustably holds the second arm in relation to the first arm. Means is also found for positioning the support bracket to a selected position on the vehicle.

The support bracket may take the form where the support bracket has a sleeve which slidingly engages the second arm. Means holds a portion of the second arm in the sleeve. In addition, the support bracket may rotate in relation to the vehicle. Also, a transverse member may be provided to permit the support bracket to slide transversely from one side of the vehicle to the other.

The front arm may be angularly connected to the vehicle to permit the roll of material on the vehicle to be close to a vertical structure.

A mechanism for stretching the unwinding from the roll may also be deemed as part of the present invention. The mechanism externalizes in a leg affixed to the vehicle and extending therefrom. First and second bars are held to the leg and may include means for positioning the same in relation to one another.

It may be apparent that a novel and useful apparatus for laying paving fabric has been described.

Is therefore an object of the present invention to provide an apparatus for laying paving fabric from a roll on a surface which may be operated by a person having a minimum of training and experience.

Another object of the present invention is to provide an apparatus for laying paving fabric which lays the fabric in proper alignment and without wrinkles.

It is yet another object of the present invention to provide an apparatus for laying paving fabric which may employ paving fabric rolls of various sizes.

Another object of the present invention is to provide an apparatus for laying paving fabric which may be collapsible in part to facilitate transportation of the apparatus from job site to job site.

Another object of the present invention is to provide a device for supporting a relatively short roll of fabric for paving on either side of the vehicle supporting such device.

Yet another object of the present invention is to provide a mechanism for stretching a fabric being unrolled to prevent wrinkles from occurring in the layed fabric.

The apparatus possesses other objects and advantages especially as concerns particular characteristics and features which will become apparent as the specification continues.

Figures 1, 6:
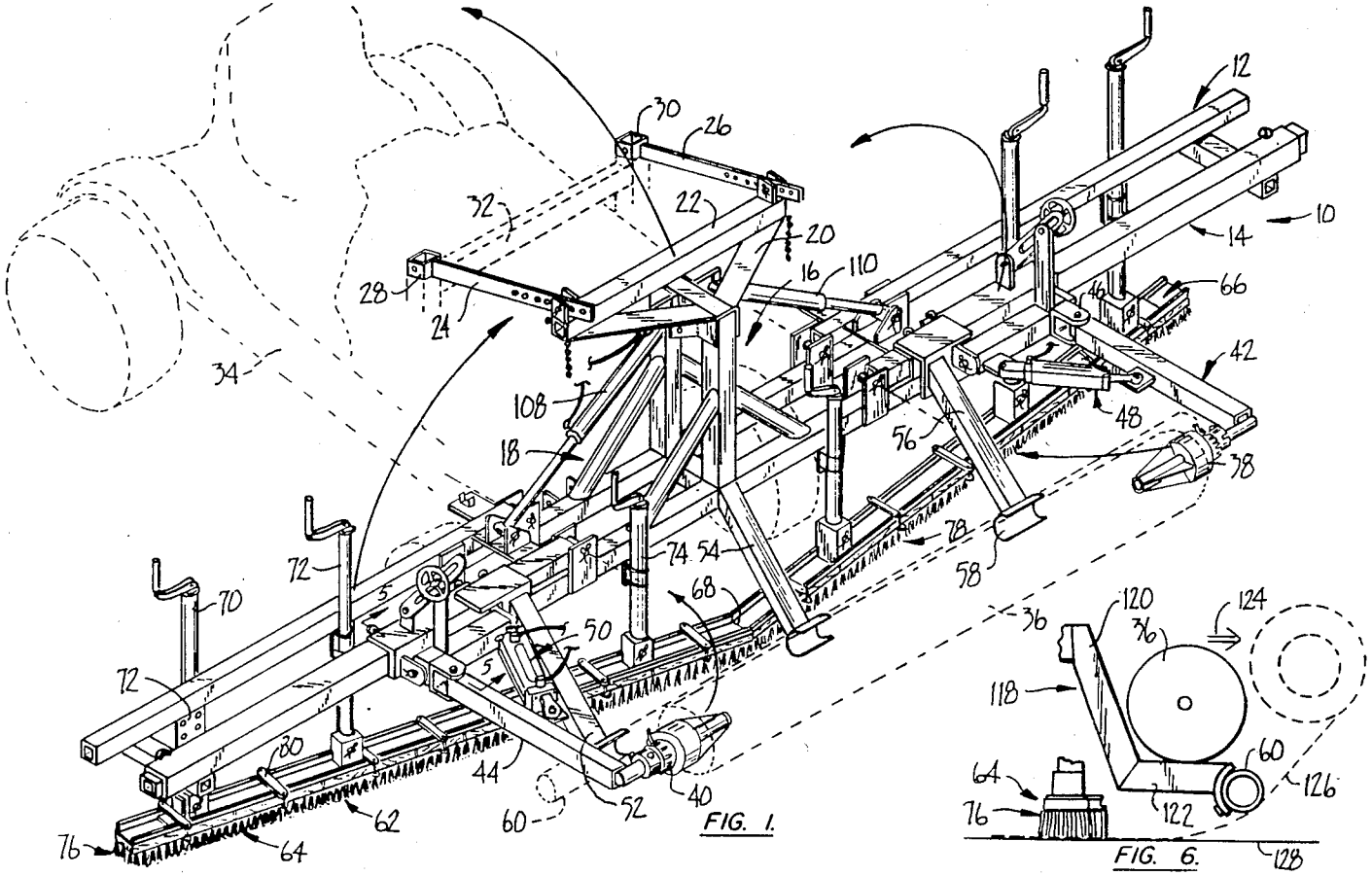
FIG. 1 is a top left side perspective view of the apparatus of the present invention showing the motivating vehicle in phantom.
FIG. 6 is a side view of an embodiment of the rod supporting arm.

For a better understanding of the invention reference is made to the following detailed description of the embodiments of the present invention which should be referenced to the hereinabove drawings.

DETAILED DESCRIPTION OF THE PREFERRED EMBODIMENTS

The apparatus as a whole is shown by reference character 10 in the drawings.

The fabric laying machine 10 includes as one of its elements a first structural member 12 and a second structural member 14. Members 12 and 14 extend transversely and laterally in relation to the paving surface. First member 12 and second member 14 are also spaced in relation to one another in that first member 12 lies behind second member 14. A post member 16 holds the first and second members in cantilever fashion. Braces 18 aid in this disposition. A bracket 20 connects to beam 22. Bracket arms 24 and 26 connect to collars 28 and 30 respectively, which fit on support means 32 provided by vehicle 34.

A roll 36 (shown in phantom) is held by tensioning spools 38 and 40 such as the tensioning spool shown in U.S. Pat. No. 3,913,854. Supports 42 and 44 hold tensioning spools in place and are substantially identical in construction to one another. Support 42 includes a pivot 46 which is moved by hydraulic means 48. The movement about pivot 46 would cause tensioning spools 38 and 40 to generally move in or out of roll 36. The hydraulic means 48 is shown in part as a hydraulic cylinder. The remaining portions of hydraulic means 48 are of conventional configuration. Likewise, hydraulic means 50 would similarly operate support 44.

Arms 52, 54, and 56 extend from second member 14 downwardly at an angle. By example arm 56 includes a semi-cylinderical termination 58 for holding a rod or pipe 60. Unwound fabric from roll 36 would pass beneath pipe 60 and to the surface, as will be hereinafter explained.

Figure 3:
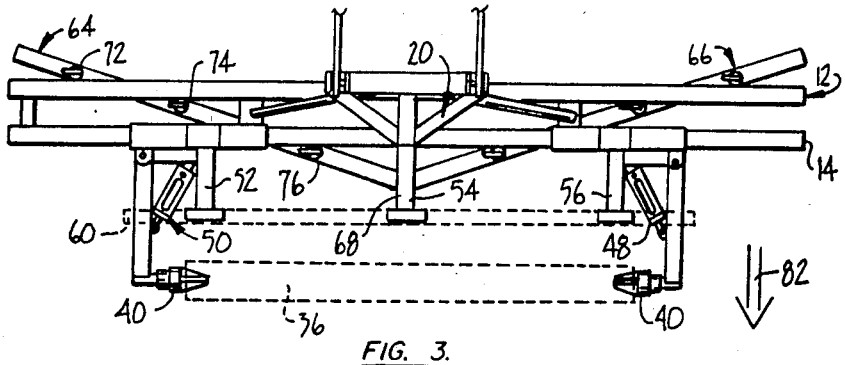
FIG. 3 is a top view showing schematically portions of the apparatus.

Means 62 is also included in the present invention for applying a downward force on the unwound paving fabric. Means 62 may take the form of a first element 64 and a second element 66 which meet at an apex or point of abutment 68. First and second elements 64 and 66 may be included as an integral part of first structural member 12 or formed separately as shown in FIG. 1. By way of illustration first element 64 is held to a jack 70 by plate 71. Jack 70 would constitute means for adjusting the downward force or pressure of first element 64. Likewise, jack 72 and jack 74 are fixed to second member 14. Brush units 76 and 78 are fixed to the bottom portion of elements 64 and 66 by the plurality of brackets such as bracket 80. Of course, brush units 76 and 78 may be held to first and second elements 64 and 66 by any other known fastening means. Referring to FIG. 3 it may be seen that first and second elements 64 and 66 form a vee or chevron pointing in the direction of movement of the apparatus 10 shown by directional arrow 82. It has been found that this angle of configuration of the brush unit 64 and 66 greatly contributes to the removing of wrinkles from the paving fabric being unwound from roll 36 as it is placed on the surface.

Figure 2A:
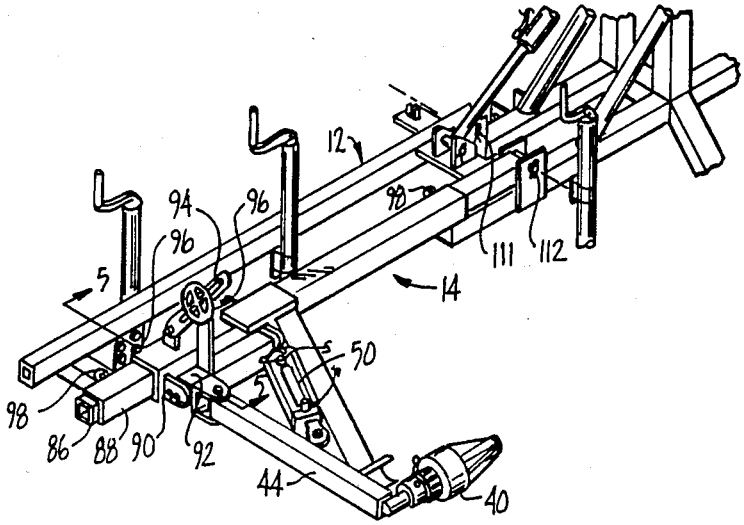
FIG. 2*a* is a top left side perspective view of the apparatus of the present invention depicting the telescoping feature.
Figure 2B:
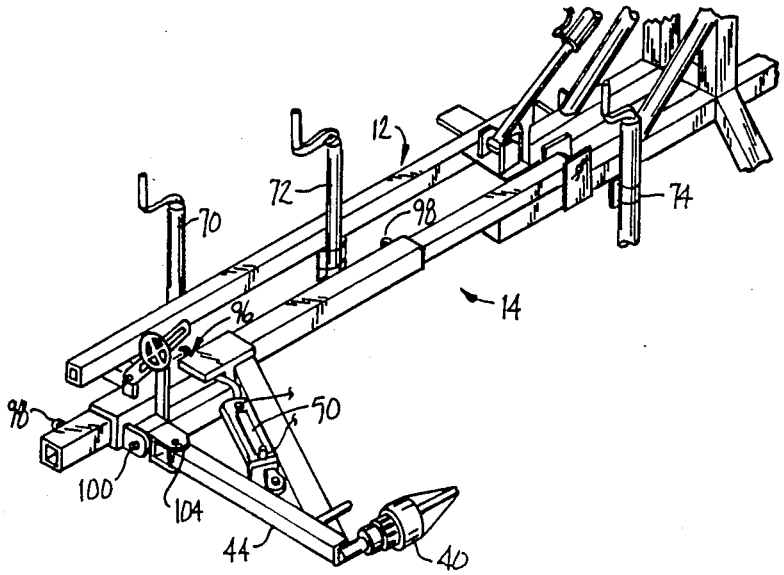
FIG. 2*b* is a top left side perspective view of the apparatus depicting the telescoping feature.

The paving apparatus 10 also includes means 84 for adjusting the lateral dimension of the second member 14. With reference to FIGS. 2*a* and 2*b* it may be seen that second structural member 14 includes an inner or first elongated section 86, a middle or second elongated section 88, and an outer or third elongated section 90. It should be noted that FIGS. 2*a* and 2*b* depict the left side of apparatus 10 and that the means for adjusting member 14 includes a similar mechanism for the right side of apparatus 10. With reference to FIG. 2*a* it may be seen that support 44 is connected to third elongated section 90 by the use of the pivot block 92. Adjustment means 94 permits the rotation of support 44 upwardly and downwardly as needed to properly tension the roll 36. A set screw or pin 98 is removed to permit third elongated section 90 to slide over second elongated section 88. The removal of pin 98 will permit the second section 88 to slide over the top of first section 86, shown in FIG. 2*b*. Thus, tensioning spool 40 may be moved laterally by the use of means 84. In addition, adjustment means 94 permits rotation of spool 40 upwardly and downwardly and hydraulic means 50 would permit the rotation of spool 40 inwardly and outwardly.

Figure 5:
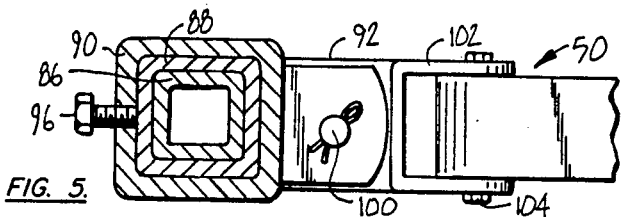
FIG. 5 is a view taken along line 5—5 of FIG. 2*a*.

With reference to FIG. 5 it may be seen that one of set pins 96 is shown holding third section 90 to second section 88. Pivot block 92 includes a pivoting rod 100 while hydraulic means 50 is shown to include U-shaped bracket 102 and hinge pin 104.

Figure 4:
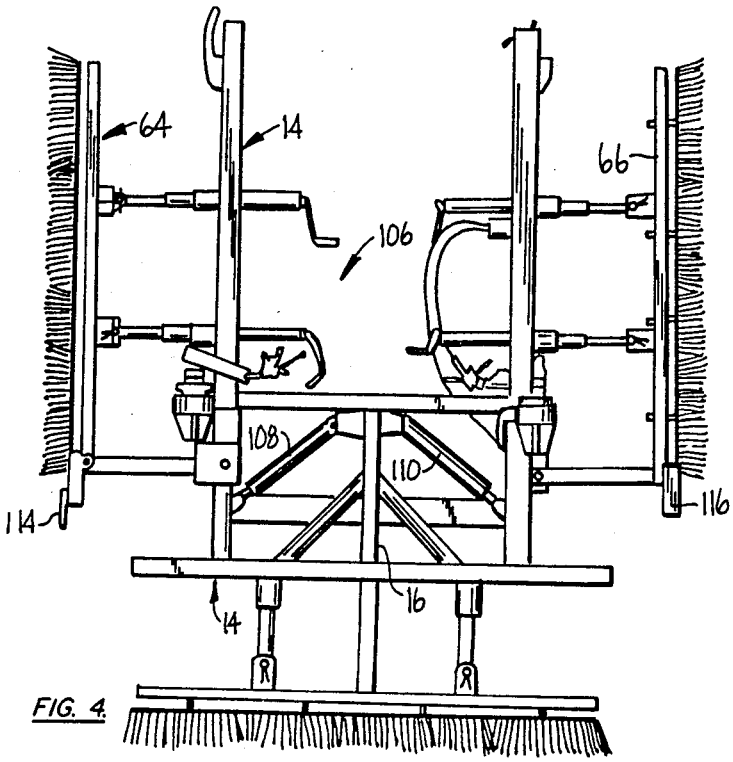
FIG. 4 is a front elevational view of the apparatus showing the upward movements of portions of the apparatus.

Turning to FIG. 4 it may be seen that apparatus 10 further comprises means 106 for rotating a portion of first and structural members 12 and 14 upwardly. Means 106 includes hydraulic cylinders 108 and 110 operated by a conventional hydraulic system such as one having a three quarter ton capacity, 11¾" stroke manufactured by A.R.P.S. Manufacturing Inc. In comparison, the hydraulic cylinder systems 48 and 50 would be similar to one having a seven ton capacity and a 6" stroke manufactured by Lantex Hydraulics, Inc. of Lancaster, Tex. Moreover, the screw adjustment jacks 70, 72 and 74 as well as the jacks shown on the right side of the apparatus 10 may be of the type having a 2" diameter 1½ ton capacity manufactured by Atwood Jacks. Hydraulic jacks may be used instead.

First and second members 12 and 14 rotate about pivot 111 and 112. Again, similar rotation pins may be found on the right side of apparatus 10, FIGS. 2*a*, 2*b* and FIG. 1. Returning to FIG. 4 it may be seen that brush units 64 and 66 split and include brackets 114 and 116 to removably fasten the same together.

With reference to FIG. 6 it may be seen that any one of arms 52, 54 or 56 may include the construction shown by arm 118. Arm 118 includes a diagonal section 120 and a horizontal bracket 122 which serves as a resting place for roll 36 before being loaded on the tensioning spools 38 and 40. Directional arrow 124 shows the movement of roll 36 and the unwinding of the fabric sheet 126 onto surface 128 and beneath brush unit 176.

Figure 7:
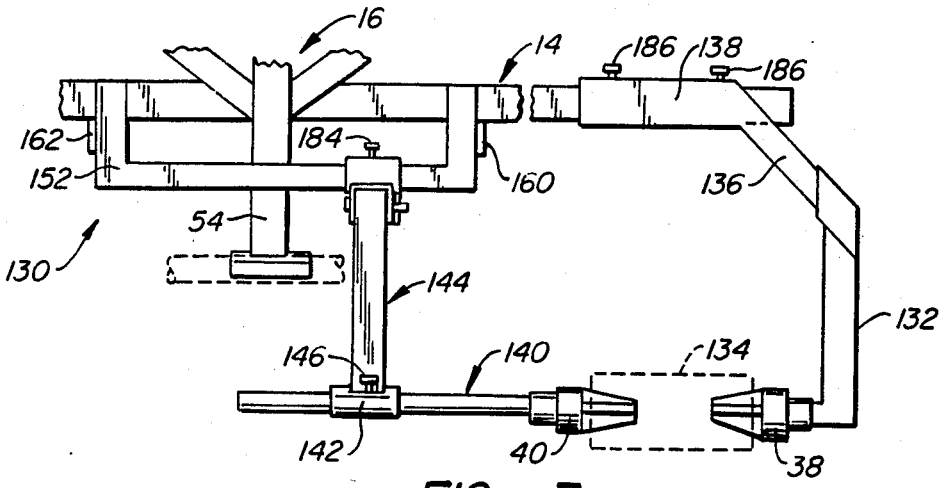
FIG. 7 is a broken top plan view of the device for supporting a short roll on vehicle.

FIG. 7 depicts a device 130 for supporting a short roll of material to the vehicle 34. Device 130 includes a first arm 132 having means 38 for tensioning the end of the short roll 134, which may have a length as small as eighteen inches. First arm 132 includes a first portion or telescoping sleeve 138, a second portion 137, and a third or angled portion 136. Sleeve 138 telescopes in relation to member 14 and is held in place by set screw 186. Angled portion 136 permits the apparatus 10 to travel very close to vertical obstructions, such as curbs, mail boxes, buildings, and the like.

A second arm 140 possesses means 40 for tensioning the end of roll 134. Arm 140 is shown in the form of a rod which fits through a sleeve 142 in support bracket 144. A set screw 146 will hold second arm 140 within sleeve 142 at various positions.

Figure 8:
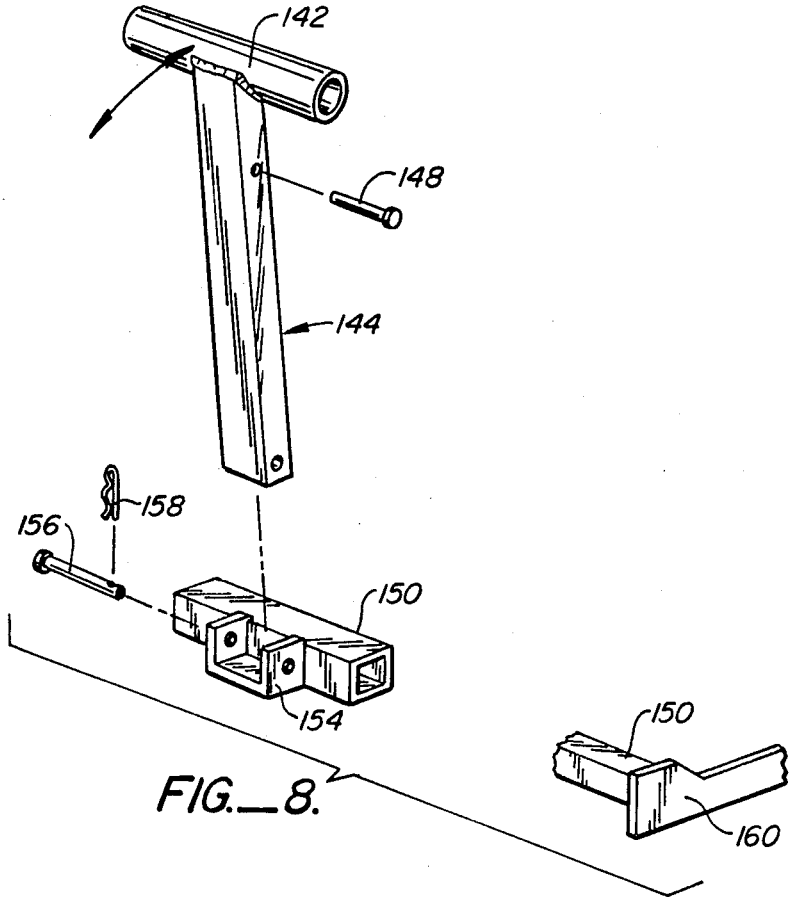
FIG. 8 is an exploded view of portions of the device depicted in FIG. 7.

With reference to FIG. 8, support bracket 144 is shown to include a pin 148 which is employed to support support bracket 144 in a vertical position to post member 16 by use of a string, rope, or chain (not shown). Structural member 150 slides along member 152 which is welded or otherwise attached to member 14. Structural member 150 includes a U-shaped support 154 which engages an end of support bracket 144. Pin 156 and cotter pin 158 hold support bracket 144 to U-shaped support 154. Bases 160 and 162 strengthen member 152 as they are both welded to member 14.

Figure 9:
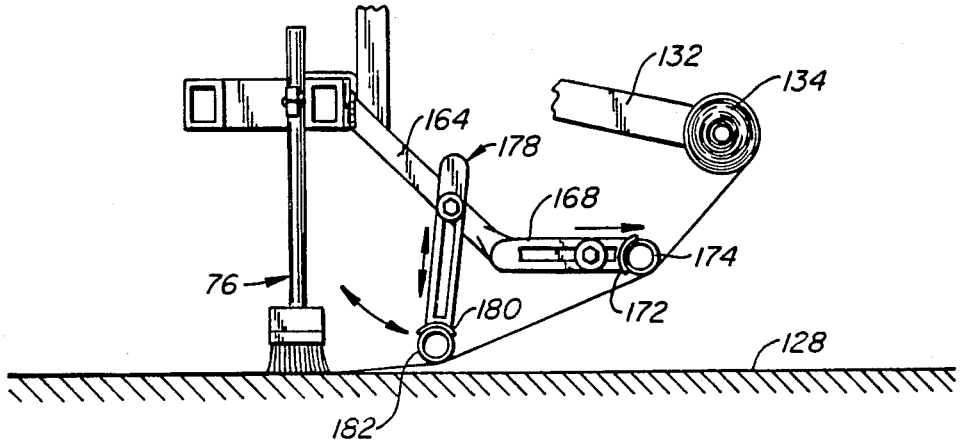
FIG. 9 is a broken side view of a mechanism for stretching the material.
Figure 10:
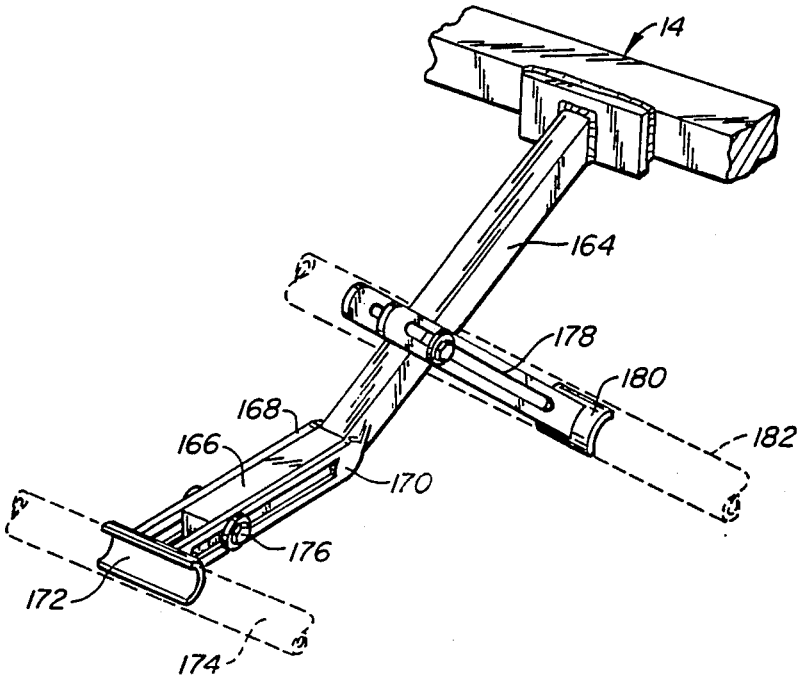
FIG. 10 is a top perspective view of the mechanism shown in FIG. 9 with portions broken in phantom.

FIG. 9 shows another embodiment of a mechanism for stretching the material unwinding from roll 134. Member 164 is welded to member 14 and angles downwardly. Member 166 extends horizontally in relation to member 164. A pair of slotted members 166 and 170 terminate in a semicircular piece 172 to hold bar 174. Bar 174 may be taped or otherwise fastened to terminal member 172. A bolt 176 permits the adjustment of slotted members 170 and 172 such that bar 170 may be positioned transversely or vertically in relation to member 164. A second pair of slotted members 178 terminate in a semicircular member 180 to hold bar 182. Thus, a second bar 182 contacts the material from roll 134 to offer a second stretching point thereto. The material then passes under brushes 76 as previously described.

In operation, the operator of apparatus 10 would load fabric roll 36 onto tensioning spools 38 and 40. The sheet on 26 would be unwound and led over bar 60 to the bottom of brush units 76 and 78. Means 84 would adjust the proper lateral spacing between tensioning spools 38 and 40 while hydraulic means 48 and 50 would force tensioning spools 38 and 40 into roll 36 as desired. Adjustment means 94 would rotate the roll 36 upwardly or downwardly as necessary to achieve the proper height of the roll above bar 60. The vehicle 34 would then be moved forward and the sheet 126 would be pressed onto surface 128 in a wrinkle-free manner. Jacks 70, 72, 74 and the others hereinbefore referenced, would be adjusted as needed to apply the proper force of the brush unit 76 and 78 to the unwound sheet 126. After being used, means 106 would be employed to raise the outer extremities of first and second members 12 and 14 for the sake of storing or transporting apparatus 10 from one job site to another job site.

Where a shorter roll must be used on either side of the vehicle 34, the embodiments shown in FIGS. 7–10 would be employed. A short roll 134, which may range between ten inches and nine feet, would be placed between tensioning chucks 38 and 40. Support bracket 144 would be positioned on third member 152 by the use of set screw 184. Finally, second arm 140 would slide through sleeve 142 and be held by set screw 146 to the proper position such that chuck 40 engages the end of roll 134. First arm 132 would be telescoped along member 14 and held in place by means 186 such that chuck 38 fits within the other end of roll 134. The operator of the apparatus 10 is then ready to lay the material within four inches of any obstructions on the right side of the apparatus as shown in FIG. 7. Of course, second arm 140 may be reversed and placed on the left side of the apparatus as shown in FIG. 7 with a similar arm to first arm 132 thereat. Thus, the short roll 134 may be laid on either side of vehicle 34. With reference to FIG. 9, it may be seen that the material unwinding from roll 134 may be stretched twice by use of bars 174 and 182. The mechanisms hereinbefore described may adjust bars 174 and 182 in relation to one another to achieve the maximum stretching. The end result is that the fabric layed upon surface 128 has a minimum number of wrinkles.

While in the foregoing embodiments of the present invention have been set forth in considerable detail to the purposes of making a complete disclosure of the invention, it may be apparent to those of skill in the art that numerous changes may be made in such detail without departing from the spirit and principles of the invention.

What is claimed is:

1. A mechanism for stretching and smoothing a sheet of paving fabric material unwinding from a roll, carried by a vehicle, onto a surface comprising:

a. a leg fixed to the vehicle and extending therefrom;

b. a first bar intended for engaging one side of the sheet of material;

c. a second bar intended for engaging the one side of the sheet of material after engagement by said first bar;

d. means for independently adjustably holding said first bar at a position relative to said leg;

e. means for independently adjustably holding said second bar at a position relative to said leg;

f. means for forcing and brushing the one side of the sheet against the surface after engagement of said sheet with said first and second bars.

* * * * *